US006003211A

United States Patent [19]

Chen

[11] Patent Number: 6,003,211

[45] Date of Patent: Dec. 21, 1999

[54] CLAMP DEVICE

[76] Inventor: Tsung-Jen Chen, 58, Ma Yuan West Street, Taichung, Taiwan

[21] Appl. No.: 09/102,133

[22] Filed: Jun. 18, 1998

[51] Int. Cl.[6] ..... A44B 21/00; D06F 55/00; E05D 7/00

[52] U.S. Cl. ..... 24/545; 24/499; 24/546; 24/557; 24/563

[58] Field of Search ..... 24/545, 563, 546, 24/557, 499, 562, 67.9

[56] References Cited

U.S. PATENT DOCUMENTS

| | | | |
|---|---|---|---|
| 1,886,015 | 11/1932 | Henning et al. | 24/562 |
| 2,629,153 | 2/1953 | Ratti | 24/546 |
| 3,733,656 | 5/1973 | Stalder | 24/557 |
| 4,763,390 | 8/1988 | Rooz | 24/562 |
| 4,839,947 | 6/1989 | Cohen et al. | 24/557 |

FOREIGN PATENT DOCUMENTS

| | | | |
|---|---|---|---|
| 1024275 | 4/1958 | Germany | 24/545 |
| 0598270 | 9/1959 | Italy | 24/557 |
| 0207775 | 10/1966 | Sweden | 24/557 |

*Primary Examiner*—Victor N. Sakran

[57] ABSTRACT

A clamp device has a first clamp plate, a second clamp plate, and a connection portion. The connection portion has a first bevel plate, a second bevel plate, and an elastic main body. The first clamp plate has a first upper end and a first lower end. The second clamp plate has a second upper end and a second lower end. The first bevel plate has a first distal end and a first connection end. The first distal end is connected to the first upper end. The second bevel plate has a second distal end and a second connection end. The second distal end is connected to the second upper end. The elastic main body has a first arm connected to the first connection end, a second arm connected to the second connection end, and a lower opening.

1 Claim, 6 Drawing Sheets

CLAMP DEVICE

BACKGROUND OF THE INVENTION

The present invention relates to a clamp device. More particularly, the present invention relates to a clamp device which can position a card stably without any adhesive.

Referring to FIGS. 1 and 2, a conventional clamp device comprises a first clamp plate 2, a second clamp plate 4, a spring 6, and a pin 8. The first clamp plate 2 has a first upper end 22, a first lug 10, and a first lower end 26. The second clamp plate 4 has a second upper end 24, a second lug 12, and a second lower end 28. The spring 6 has a first end 18 contacting the first upper end 22 of the first clamp plate 2 and a second end 20 contacting the second upper end 24 of the second clamp plate 4. The pin 8 passes through a through hole 16 and the spring 6. The first lower end 26 of the first clamp plate 2 often contacts the second lower end 28 of the second clamp plate 4. When the user presses the first upper end 22 of the first clamp plate 2 and the second upper end 24 of the second clamp plate 4 inward, the first lower end 26 of the first clamp plate 2 and the second lower end 28 of the second clamp plate 4 will extend outward. A card (not shown in the figures) is adhered on the conventional clamp device. However, the card may be detached from the conventional clamp device if the adhesive becomes useless.

SUMMARY OF THE INVENTION

An object of the present invention is to provide a clamp device which can position a card stably without any adhesive.

Accordingly, a clamp device comprises a first clamp plate, a second clamp plate, and a connection portion disposed between the first clamp plate and the second clamp plate. The connection portion has a first bevel plate, a second bevel plate, and an elastic main body disposed between the first bevel plate and the second bevel plate. The first clamp plate has a first upper end and a first lower end. The second clamp plate has a second upper end and a second lower end. The first bevel plate has a first distal end and a first connection end. The first distal end is connected to the first upper end of the first clamp plate. The second bevel plate has a second distal end and a second connection end. The second distal end is connected to the second upper end of the second clamp plate. The elastic main body has a first arm connected to the first connection end of the first bevel plate, a second arm connected to the second connection end of the second bevel plate, and a lower opening defined by the first arm and the second arm. The first clamp plate further comprises two Y-shaped elastic caliper plates defining a center hole and a plurality of slots.

DETAILED DESCRIPTION OF THE INVENTION

Figure 3:
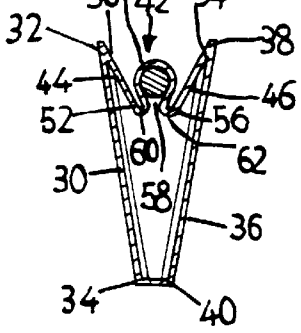
FIG. 3 is a sectional view of a clamp device of a preferred embodiment in accordance with the present invention.
Figure 4:
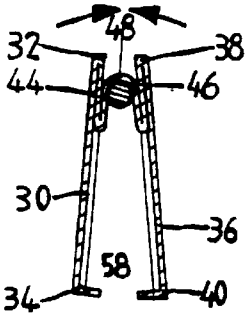
FIG. 4 is a sectional view of a clamp device of a preferred embodiment while a first lower end of a first clamp plate and a second lower end of a second clamp plate divorce outward.
Figure 1:
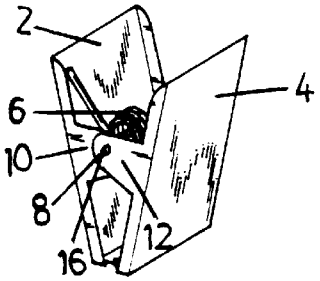
FIG. 1 PRIOR ART
FIG. 1 is a perspective view of a conventional clamp device of the prior art.
Figure 2:
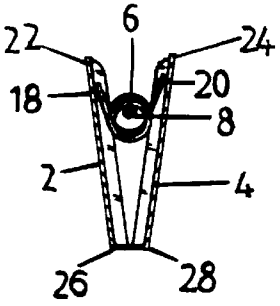
FIG. 2 PRIOR ART
FIG. 2 is a sectional view of a conventional clamp device of the prior art.
Figure 5:
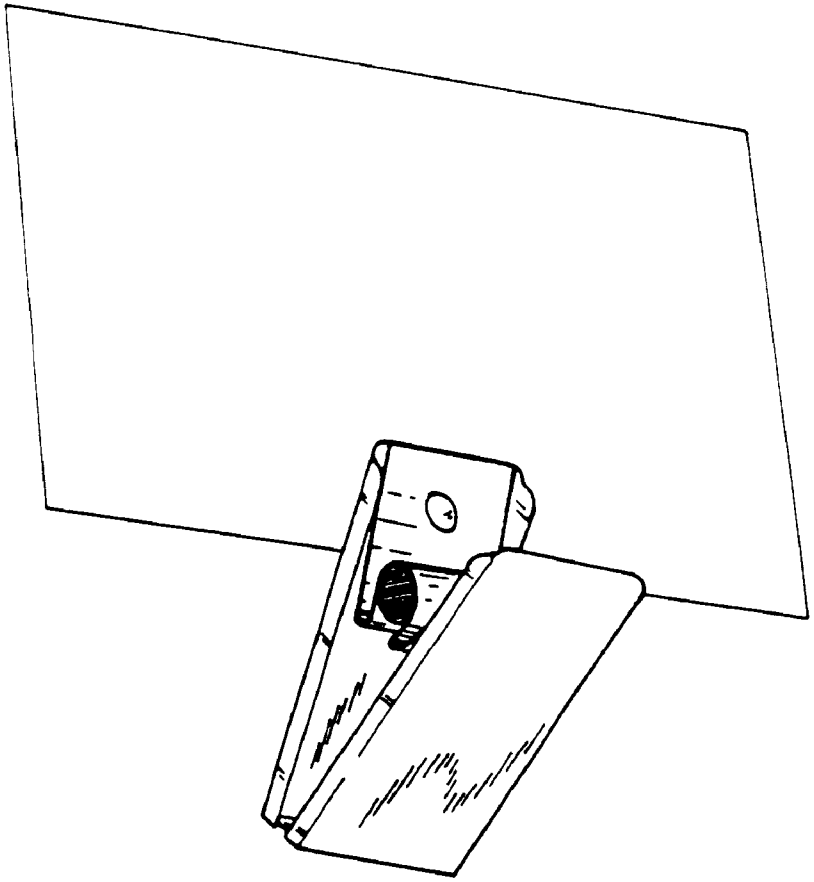
FIG. 5 is a perspective view of a clamp device of a preferred embodiment in accordance with the present invention.
Figure 6:
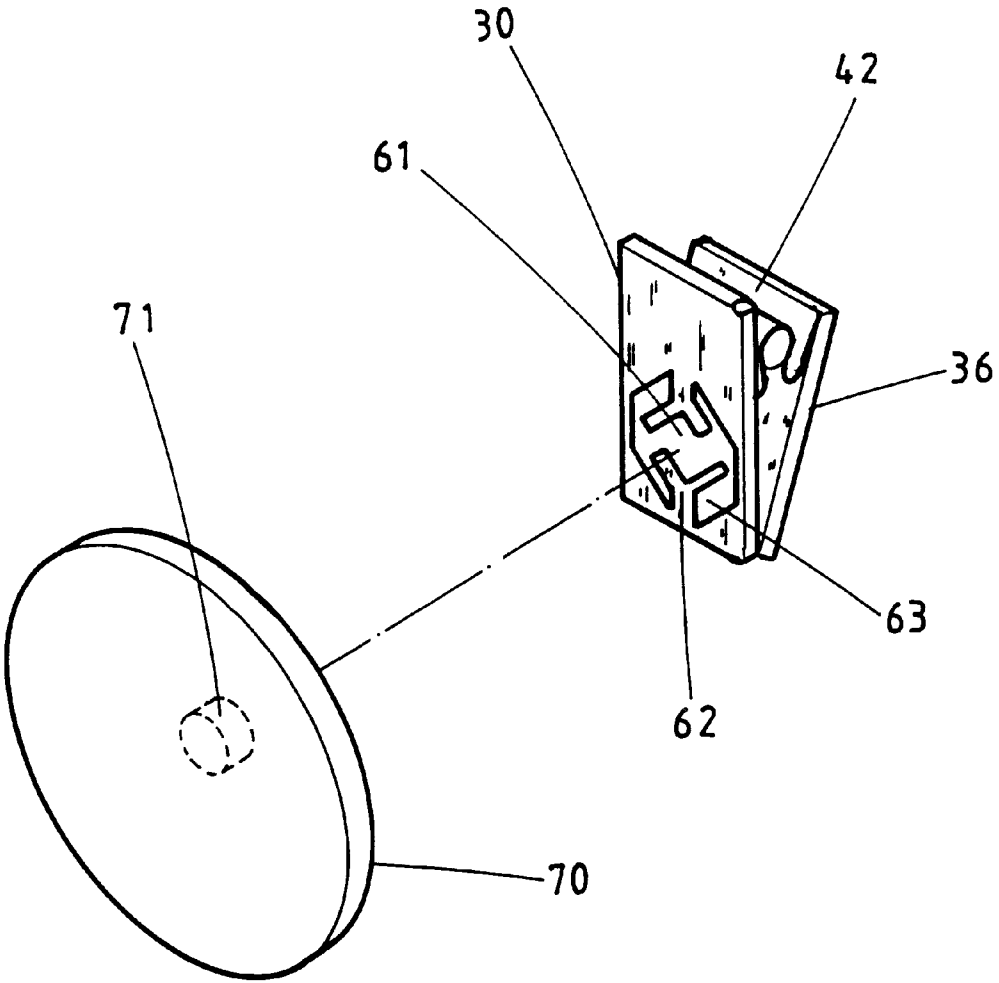
FIG. 6 is a perspective exploded view of a disk and a clamp device of a preferred embodiment in accordance with the present invention.
Figure 8:
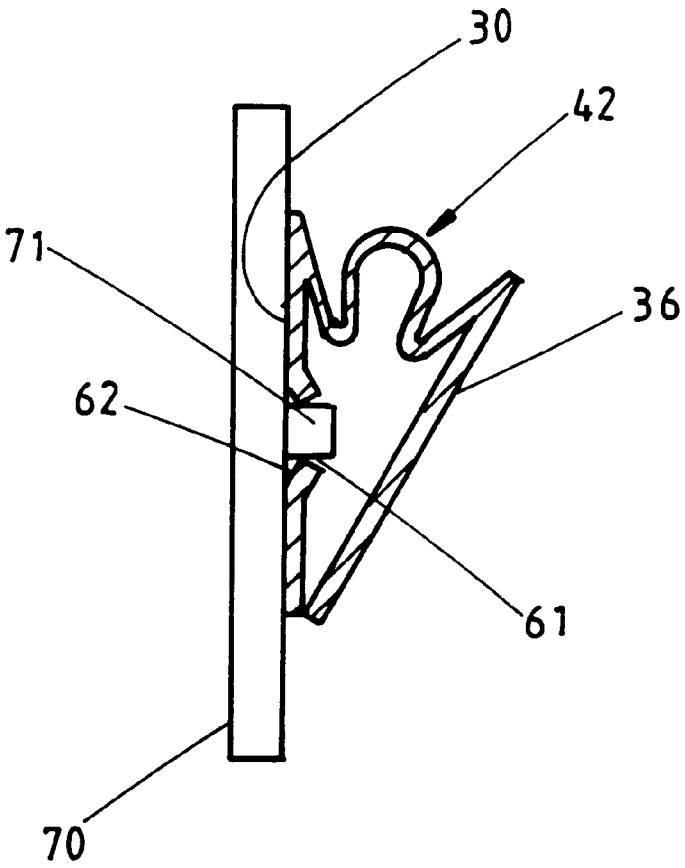
FIG. 8 is a schematic view illustrating a disk engages with a clamp device of a preferred embodiment in accordance with the present invention.
Figure 7:
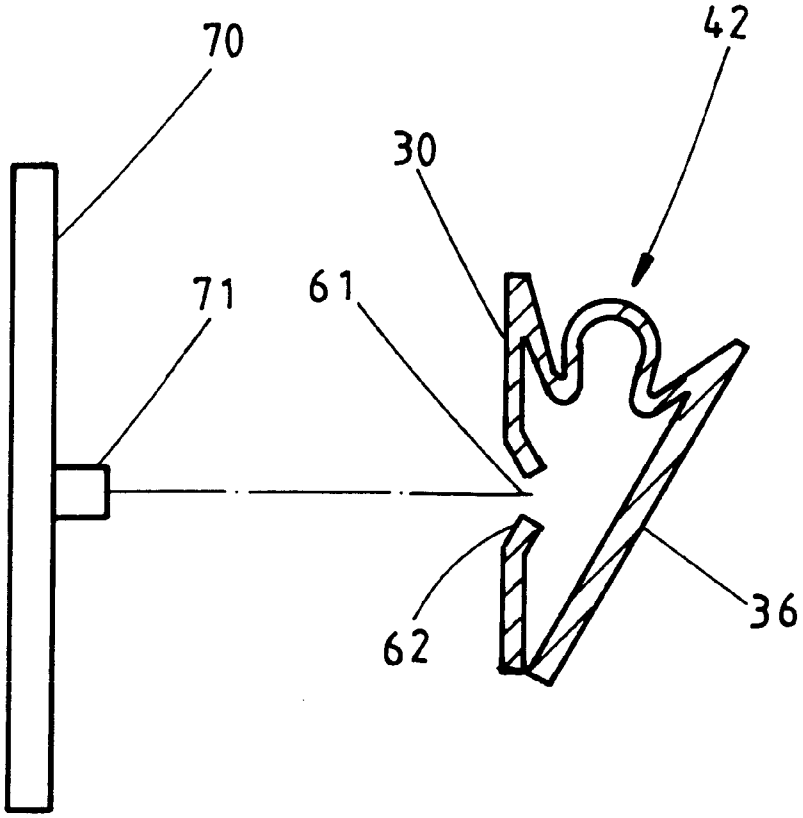
FIG. 7 is a schematic view illustrating a disk is released from a clamp device of a preferred embodiment in accordance with the present invention.
Figure 9:
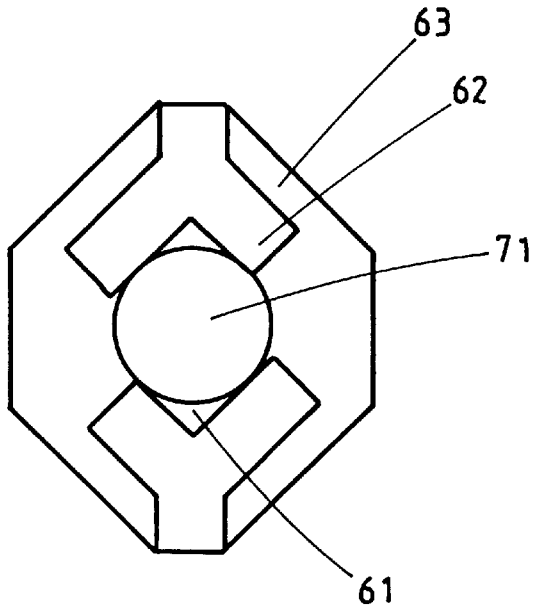
FIG. 9 is a schematic view illustrating two Y-shaped caliper plates clamp a post.

Referring to FIGS. 3 to 5, a clamp device comprises a first clamp plate 30, a second clamp plate 36, and a connection portion 42 disposed between the first clamp plate 30 and the second clamp plate 36. The connection portion 42 has a first bevel plate 44, a second bevel plate 46, and an elastic main body 48 disposed between the first bevel plate 44 and the second bevel plate 46.

The first clamp plate 30 has a first upper end 32 and a first lower end 34.

The second clamp plate 36 has a second upper end 38 and a second lower end 40.

The first bevel plate 44 has a first distal end 50 and a first connection end 52. The first distal end 50 is connected to the first upper end 32 of the first clamp plate 30. The second bevel plate 46 has a second distal end 54 and a second connection end 56. The second distal end 54 is connected to the second upper end 38 of the second clamp plate 36.

The elastic main body 48 has a first arm 60 connected to the first connection end 52 of the first bevel plate 44, a second arm 64 connected to the second connection end 56 of the second bevel plate 46, and a lower opening 58 defined by the first arm 60 and the second arm 64.

When the user presses the first upper end 32 of the first clamp plate 30 and the second upper end 38 of the second clamp plate 36 inward, the first lower end 34 of the first clamp plate 30 and the second lower end 40 of the second clamp plate 36 will divorce outward.

When the force is released from the first upper end 32 of the first clamp plate 30 and the second upper end 38 of the second clamp plate 36, the first bevel plate 44 and the second bevel plate 46 will push the first upper end 32 of the first clamp plate 30 and the second upper end 38 of the second clamp plate 36 outward.

Referring to FIGS. 6 to 9, a disk 70 has a center post 71. The first clamp plate 30 has two Y-shaped elastic caliper plates 62 defining a rhombic center hole 61 and a plurality of slots 63. The center post 71 is inserted in the rhombic center hole 61 and clamped by the Y-shaped elastic caliper plates 62.

Figure 10:
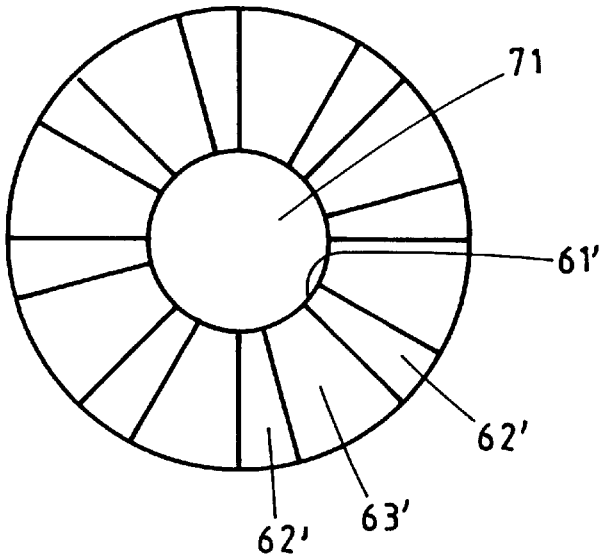
FIG. 10 is a schematic view illustrating a plurality of caliper plates clamp a post.
Figure 11:
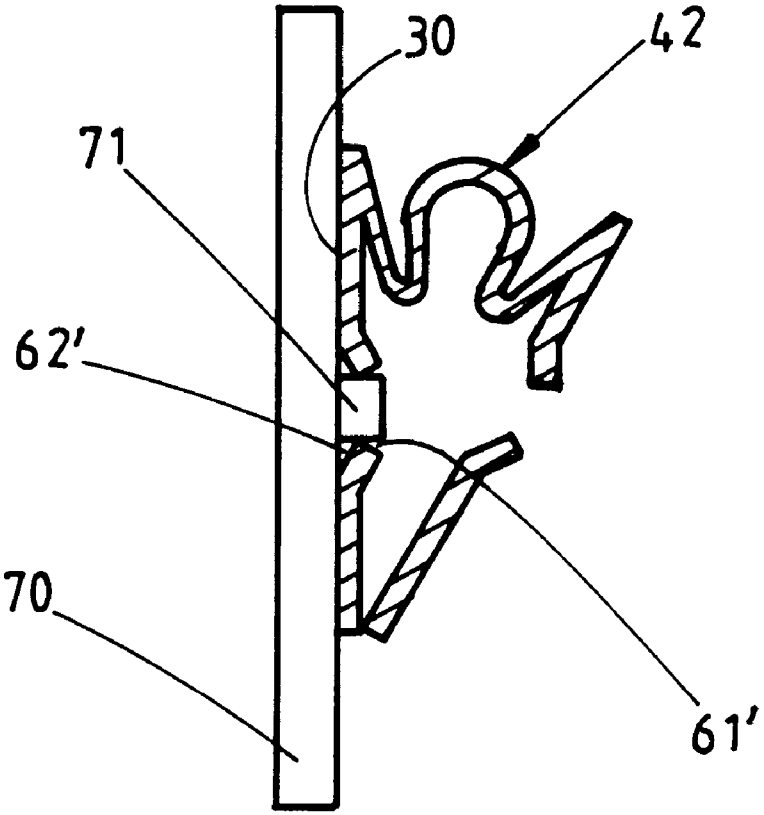
FIG. 11 is a schematic view illustrating a disk engages with a clamp device of another preferred embodiment in accordance with the present invention.

Referring to FIGS. 10 and 11, a disk 70 has a center post 71. The first clamp plate 30 has a plurality of elastic caliper plates 62' defining a round center hole 61' and a plurality of slots 63'.

The invention is not limited to the above embodiment but various modification thereof may be made. Further, various changes in form and detail may be made without departing from the scope of the invention.

I claim:

1. A clamp device comprises:

a first clamp plate, a second clamp plate, and a connection portion disposed between the first clamp plate and the second clamp plate, the connection portion having a first bevel plate, a second bevel plate, and an elastic main body disposed between the first bevel plate and the second bevel plate, the first clamp plate having a first upper end, a first lower end, and a plurality of elastic caliper plates defining a center hole and a plurality of slots, the second clamp plate having a second upper end and a second lower end, the first bevel plate having a first distal end and a first connection end, the first distal end connected to the first upper end of the first clamp plate, the second bevel plate having a second distal end and a second connection end, the second distal end connected to the second upper end of the second clamp plate, the elastic main body having a first arm connected to the first connection end of the first bevel plate, a second arm connected to the second connection end of the second bevel plate, and a lower opening defined by the first arm and the second arm, and a disk having a center post inserted in the center hole and clamped by the elastic caliper plates.

* * * * *